United States Patent [19]

Sivilotti

[11] Patent Number: 4,604,177

[45] Date of Patent: Aug. 5, 1986

[54] ELECTROLYSIS CELL FOR A MOLTEN ELECTROLYTE

[75] Inventor: Olivo G. Sivilotti, Kingston, Canada

[73] Assignee: Alcan International Limited, Montreal, Canada

[21] Appl. No.: 700,293

[22] Filed: Feb. 11, 1985

Related U.S. Application Data

[62] Division of Ser. No. 513,234, Jul. 13, 1983, Pat. No. 4,514,269.

[30] Foreign Application Priority Data

Aug. 6, 1982 [GB] United Kingdom ..... 8222665

[51] Int. Cl.[4] ..... C25C 3/04; C25C 3/22

[52] U.S. Cl. ..... 204/244; 204/247; 204/268

[58] Field of Search ..... 204/70, 245, 246, 247, 204/268, 244

[56] References Cited

U.S. PATENT DOCUMENTS 4,334,975 6/1982 Ishizuka ..... 204/247

4,481,085 11/1984 Ishizuka ..... 204/245

*Primary Examiner*—Donald R. Valentine

*Attorney, Agent, or Firm*—Cooper, Dunham, Clark, Griffin & Moran

[57] ABSTRACT

A cell for producing magnesium or other metal by electrolysis of molten chloride or other electrolyte comprises at least one electrode assembly of an anode 24, at least one intermediate bipolar electrode 28, 30, 32, 34 and a cathode 26 defining generally vertical inter-electrode spaces between them. To minimize current leakage, the intermediate bipolar electrodes preferably almost completely surround the anode including the edges and the bottom.

In operation, a metal/electrolyte mixture is swept up the interelectrode spaces by generated chlorine gas and spills out over the cathode into a duct 20 behind the cathode, the duct including a restricted passage 58 for degassing and an inverted channel 62 to collect product metal and convey it to a metal collection chamber 18.

The electrolyte surface is preferably maintained at about the level of the top edges of the intermediate bipolar electrodes by means of a level control device 22 submerged in electrolyte in the metal collection chamber.

4 Claims, 5 Drawing Figures

104
124
C
121
120
144
158
134
136
138
156
164
118
D
122
110
119
108
152
153
100
C
D

ELECTROLYSIS CELL FOR A MOLTEN ELECTROLYTE

This is a division of application Ser. No. 06/513,234, filed July 13, 1983, now U.S. Pat. No. 4,514,269.

This invention relates to a method and a cell for metal production by electrolysis of a molten electrolyte which is more dense than the metal. The invention will be particularly described with reference to the production of magnesium by electrolysis of a molten electrolyte containing magnesium chloride. But it should be understood that the invention is also applicable to other electrolytes and other metals.

In the electrolysis of molten electrolytes containing magnesium chloride, magnesium is formed at the cathode and chlorine at the anode. Since both are lighter than the electrolyte, both migrate to the surface. If the magnesium and the chlorine come into contact with one another, they tend to re-combine, and this is a major cause of production losses. The tendency is a function of the contact time, the intimacy of contact and the electrolyte temperature.

The classical solution to this problem was to separate anode and cathode regions by means of a diaphragm. But a diaphragm considerably increases the interelectrode distance and therefore the internal resistance of the cell and although this solution has been used commercially for many years, the more recent industrial practice has favoured diaphragmless cells. Cells without diaphragms may be divided into two categories:

(i) those cells designed to keep the magnesium generated at the cathode essentially free from contact with the chlorine generated at the anode. To do this, it is necessary to keep a substantial distance between facing electrodes, and this in turn means that a substantial amount of electrical energy must be spent overcoming the electrical resistance of the electrolyte.

Such cells have high current efficiency because magnesium/chlorine recombination is substantially prevented.

(ii) those cells designed to use the chlorine to lift the magnesium droplets to the surface of the electrolyte. The anode/cathode spacing can be greatly reduced, thus reducing the internal resistance of the cell, but the current efficiency is lowered by reason of back reaction of Mg and $Cl_2$. The current efficiency of the cell is dependent upon the rapidity of separation of the product Mg from the generated chlorine. The cells of this invention are in category (ii).

One of the cells of category (i) is described in U.S. Pat. No. 4,055,474 by this inventor. In this cell use is made of inverted steel troughs extending above each cathode and beneath the surface of the bath to receive the rising metal and conducting it to a suitable metal collection locality separated from the main chlorine collecting chamber. The electrolyte circulation is obtained by the gas lift effect in the interelectrode space. After release of the chlorine above the steel troughs the electrolyte flows downwards in spaces provided on the back of the cathode faces.

The same product separating technique has been recently proposed (European Patent Specification 27016A) for a cell provided with intermediate bipolar electrodes where inverted troughs are designed on the cathodic surfaces for the individual collection of magnesium metal and delivery outwards to a separate reservoir. A similar arrangement is suggested for the collection of chlorine on the anodic surfaces. The interelectrode spacings and the inclination of the electrode surfaces, especially the cathodic surfaces, are selected to satisfactorily separate the two products. Experience has shown that a minimum spacing of 5 cm is necessary to prevent mixing and therefore a substantial voltage drop results, even when the electrode geometry is optimized, from the passage of current at the densities required to produce commercial quantities of magnesium.

A cell in category (ii) is described in U.S. Pat. No. 3,907,651, in which there are used assemblies of double-acting anodes and double-acting cathodes, the latter each having a passage between the two anode-facing surfaces through which an electrolyte/magnesium mixture passes to a separate metal collection chamber. A restriction may be provided at the entrance to this passage to assist in the separation of chlorine from the liquid mixture. The design suffers from the difficulty of designing the passage so that the flow of electrolyte is sufficiently fast to maintain magnesium droplets in suspension but sufficiently slow to permit complete degassing.

Multipolar cells of category (ii) have been proposed (U.S. Pat. Nos. 2,468,022 and 2,629,688) where the collection of magnesium is effected by circulating the electrolyte towards a metal collecting locality by means of a mechanical pump: the interelectrode spaces between bipolar vertical slabs are swept by the circulating electrolyte and the magnesium produced is made to overflow into a common sump disposed alongside the spaces and separated from them by submerged weirs which prevent the passage of chlorine from the electrolysis chamber and the sump. The metal is retained by a dam disposed in the metal collecting chamber, so that only electrolyte is pumped back into the electrolysis chamber. The operating difficulties arising from the need to maintain the pump in continuous use in spite of the difficult environment are well known to those skilled in the art. This may be the reason why these cells have not been very successful commercially.

We have now found a method to effect the separation of magnesium in cells of multipolar design by means of circulating electrolyte without the use of pumps. The electrolyte circulation is obtained by using small interelectrode spaces and a high current density at the electrodes which leads to a high rate of lift of electrolyte (because of the high rate of chlorine flow in the interelectrode spaces) without however any excessive voltage drop (because of the small interelectrode distance) and to a satisfactory current efficiency (because of the very rapid separation of the products).

In our copending patent application Ser. No. 498,848 (filed on the May 27, 1983) now U.S. Pat. No. 4,518,745 the electrolyte circulation is made to occur sideways in the planes of the interelectrode spaces. In that mode of circulation the time required for the electrolyte/metal mixture to reach the side discharge point increases with the increasing width of the electrodes, so that a limit is reached for the optimum electrode width beyond which the current efficiency of the cell becomes less advantageous.

We have now found a method to overcome this problem and still retain all the other advantages described in the copending patent application.

The present invention provides in one aspect an electrolytic cell for the production of a metal by electrolysis of a molten electrolyte which is more dense than the metal, comprising, an electrolysis chamber including at least one electrode assembly of an anode, one or more intermediate bipolar electrodes, and a cathode having a front face facing an intermediate bipolar electrode and a back face, the electrodes defining electrolysis regions between them, and a gas collection space above the assembly, a metal collection chamber in communication with the top and bottom of the electrolysis regions, but screened from the gas collection space, a duct extending adjacent the back face of the cathode and leading to the metal collection chamber, including a restricted passage for electrolyte/metal mixture and, downstream of the restricted passage, an inverted channel for metal collection contoured to cause metal to flow to the metal collection chamber, the one or more intermediate bipolar electrodes having top edges arranged to permit electrolyte/metal mixture rising from the electrolysis regions to spill out over the cathode and into the duct, and means for maintaining the surface of the electrolyte/metal mixture at a substantially constant level.

The present invention provides in another aspect a process for the production of a metal by electrolysis of a molten metal chloride electrolyte which is more dense than the metal, which method comprises, introducing electrolyte into the lower ends of interelectrode regions between the electrodes of one or more assemblies each comprising an anode, a cathode and one or more intermediate bipolar electrodes, passing an electric current between the anode and the cathode whereby chlorine is generated at anodic electrode faces, the metal is generated at cathodic electrode faces, and an electrolyte/metal/chlorine mixture is caused to rise up the interelectrode regions, causing the electrolyte/metal mixture which emerges from the upper ends of the interelectrode regions to spill over the or each intermediate bipolar electrode and over the cathode and to pass down a restricted passage behind the cathode, maintaining the liquid surface level at a substantially constant height to effect substantially complete separation of chlorine from the electrolyte metal mixture at or upstream of the restricted passage without permitting a significant proportion of electric current to bypass the intermediate electrode(s), and downstream of the restricted passage, separating and recovering metal from electrolyte/metal mixture into an inverted channel leading to a metal collection region and recirculating electrolyte to the lower ends of the interelectrode regions.

Intermediate bipolar electrodes used in this invention are valuable in that they increase the effective cathode area on which metal formation can take place, without either increasing the size of the cell or increasing the heat and power loss involved in providing large numbers of external electrical connections. One problem which intermediate bipolar electrodes generate is that of current leakage. Because the polarization voltage arising from the electrolysis process in each interelectrode space is quite high, current tends to flow where possible through the electrolyte/metal mixture and round, rather than through, the intermediate bipolar electrodes. This invention provides several features designed to mitigate this problem:

(a) Current leakage over the top of the intermediate bipolar electrodes can be minimised by operating a level control device to keep the liquid surface at about the level of the top edges of these electrodes. Thus, the liquid surface should preferably be no higher than is necessary to permit the electrolyte/metal mixture rising from the electrolysis regions to spill out over the cathode and into the duct.

(b) Current leakage around the ends of the intermediate bipolar electrodes can be substantially avoided by providing electrical insulation, e.g. refractory blocks adjacent each end of the electrode assembly. But such blocks are inevitably worn away or cracked during prolonged operation, leading to a gradual increase in by-pass currents.

(c) Current leakage below the bottom edges of the intermediate bipolar electrodes cannot be entirely eliminated because of the need to provide passages for the entry of electrolyte to the lower ends of the electrolysis regions. Current leakage here can be minimised by restricting the size of the passages and/or by providing a tortuous flow path for the electrolyte (and the electric current).

(d) In a preferred embodiment of this invention, intermediate bipolar electrodes and cathodes are arranged, not only facing the major faces of the anode, but also facing the ends and/or the bottom faces of the anode. By this means, each anode can be completely surrounded by intermediate bipolar electrodes. The design nests completely the high voltage zone surrounding the anode, and provides a very functional electrode configuration which allows the use of a relatively large number of poles in the cell without suffering significantly from the problem of current by-pass and refractory wear.

In operation, a mixture of electrolyte, molten metal and gas, typically chlorine, streams upwards through the electrolysis regions. The electrolyte/metal mixture spills over the or each intermediate bipolar electrode, over the cathode and into the duct behind the cathode. For this to be possible, it is necessary that the top edge of the intermediate bipolar electrode adjacent the front face of the cathode be at least as high as the top edge of the cathode. If there are more than one intermediate electrodes, no intermediate electrode should be significantly higher than one between it and the anode. Preferably, the tops of all the intermediate bipolar electrodes (when more than one is used) are substantially at the same height or are located on a slight incline going up from cathode to anode. To provide a uniform flow of electrolyte/metal mixture over them, the top edges of the intermediate bipolar electrode(s) and the cathode should be essentially horizontal along their length.

The duct extending adjacent the back face of the cathode includes a restricted passage for electrolyte/metal mixture, preferably at substantially the level of the top edge of the cathode. This restricted passage serves to control the flow of the mixture so as to provide a pressure drop which prevents metal droplets from returning countercurrent through it, this pressure differential being sufficient to prevent metal collected in the inverted channel and in the metal collection chamber from returning to the electrolysis chamber if a leak develops. Therefore, efficient collection of metal will be retained for a long time until cell damage is extensive.

The restricted passage may be constituted by baffles that function as gas deflectors and separators at the entrance to the duct. The design of these deflectors may follow conventional hydrodynamic principles. If the liquid surface level is too high, a significant proportion of electric current may by-pass the intermediate electrode(s) and also molten metal may coalesce in the electrolysis chamber, floating in the gas collection space rather than being entrained in the circulating electrolyte. If the level is too low, chlorine or other gas may be carried over into the metal collection chamber. Preferably, the surface is maintained at substantially the level of the top edges of the intermediate bipolar electrode(s). A level control device may be provided to maintain the liquid surface level substantially constant. This device may take the form of a vessel, partly or wholly submerged in the electrolyte of the metal collection chamber, to or from which electrolyte can be transferred to alter the surface level. Alternatively, the liquid surface level can be maintained substantially constant by continuous or frequently intermittent tapping of molten metal and/or introduction of fresh raw material.

The number of intermediate bipolar electrodes per electrode assembly is not critical, and may conveniently be from 1 to 7. The electrodes may be arranged vertically or at a small angle to the vertical. Cathodes or intermediate bipolar electrodes which face the bottom of an anode may need to be set at an angle or even horizontal, but the extent of such electrodes should preferably be limited. The cell may include a single electrode assembly. Alternatively, the cell may include several, e.g. 3 to 8, electrode assemblies, with double-acting cathodes between assemblies. The double-acting cathodes may include two metal plates constituting the cathodes with between them a duct leading to the metal collection chamber.

The cells of this invention are designed to operate at temperatures only slightly above the melting point of the metal being produced, so as to minimise back-reaction between the metal and chlorine. When used to produce magnesium (M.P. 651°) the cell is preferably operated at 655° C.-695° C., particularly 660° C. to 670° C.

The cells of this invention are designed to be operated at high current densities, typically from 0.3 $A/cm^2$ to 1.5 $A/cm^2$, and small interelectrode spacings, typically 4 mm to 25 mm. The anodes and intermediate bipolar electrodes are preferably of graphite, but may be a composite with a graphite anodic face and a steel cathodic face. Under these conditions, electrode dimensions are rather critical to cell efficiency, so all normal precautions must be taken to prevent entry of air or moisture into the electrolysis chamber so as to reduce consumption of the graphite anodes and intermediate electrodes. Usually, the gas collection space in the electrolysis chamber is contained within a closure through which the anodes project. Preferably, there is provided also a single secondary hood surrounding the anodes, or a secondary hood surrounding each anode. The space(s) between the closure and the secondary hood(s) may be filled with inert gas.

The metal collection chamber may be sealed according to the method described in European Patent Specification 60048 A.

Reference is directed to the accompanying drawings, in which.

Figure 1:
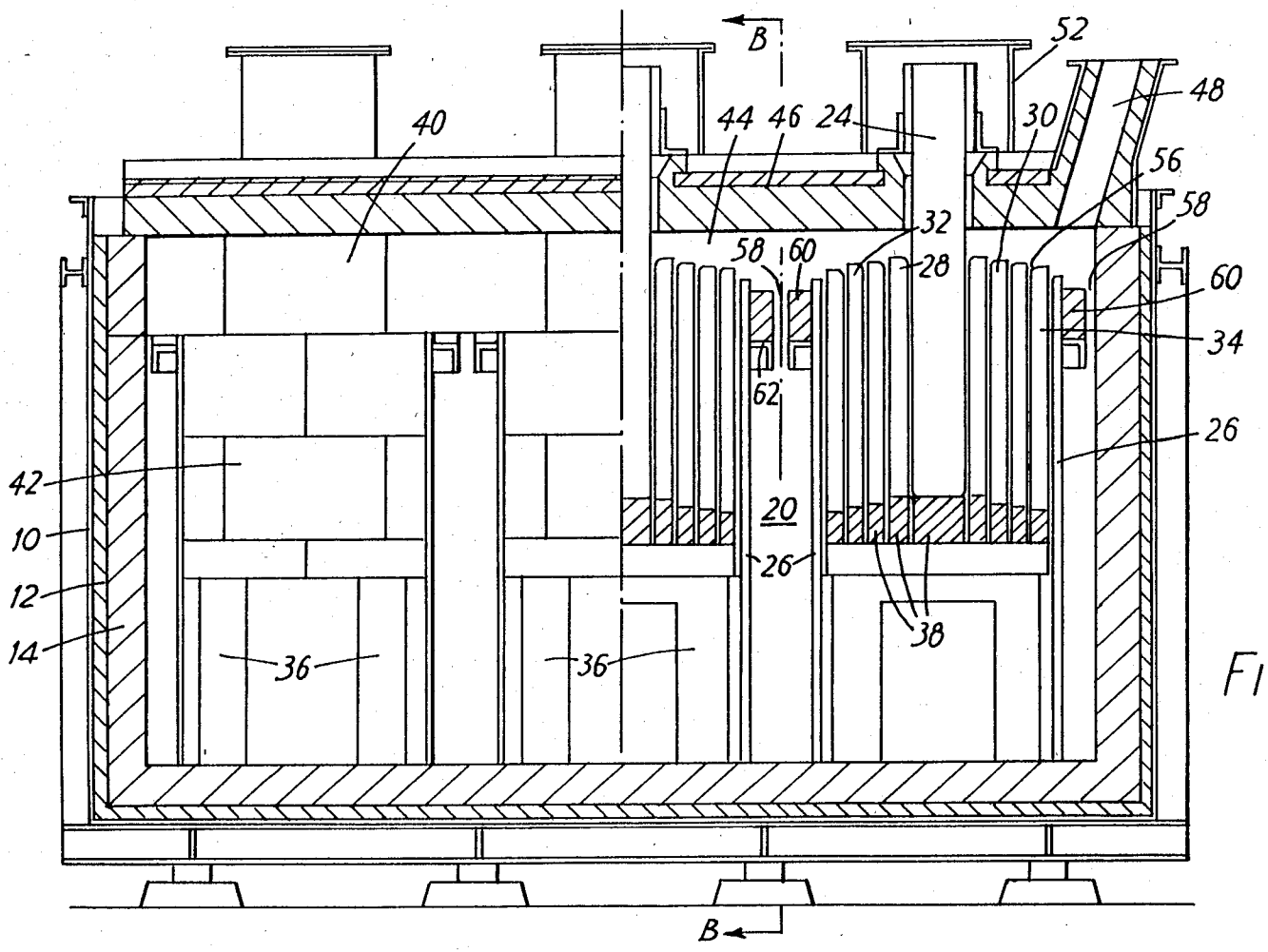
FIG. 1 is a front elevation of an electrolytic cell according to the invention, sectioned at two planes (marked A and A in FIG. 2)
Figure 2:
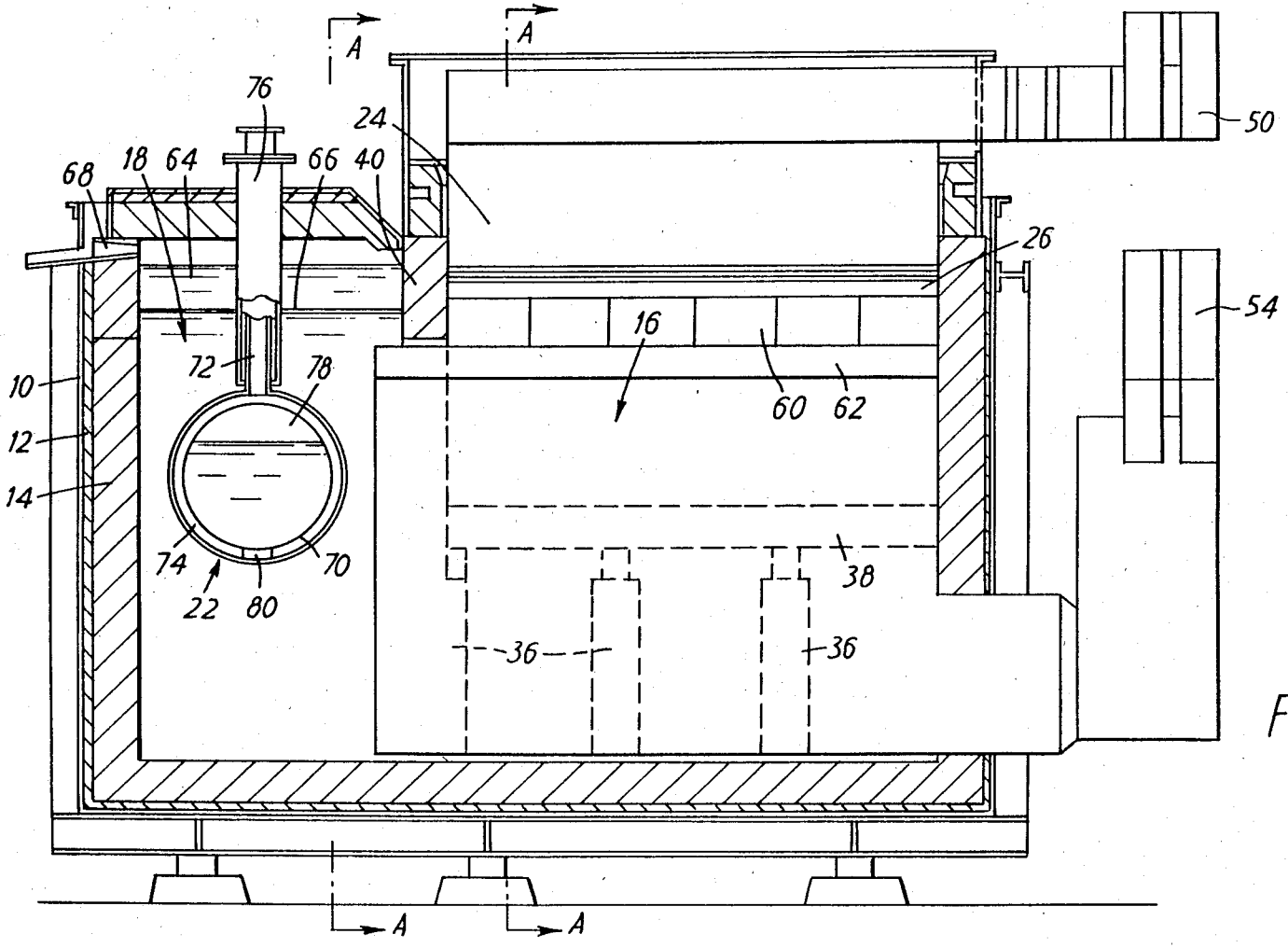
FIG. 2 is a sectional side elevation along the line B—B of FIG. 1.

Referring to FIGS. 1 and 2, the electrolytic cell comprises a steel outer shell 10, and layer 12 of thermal insulation, and a massive refractory lining 14 of material which is resistant to both molten magnesium (when the cell is designed to produce magnesium) and the molten electrolyte to be used. The cell includes an electrolysis chamber 16, a magnesium collection chamber 18, a duct 20 leading from the top of the electrolysis chamber 16 to the metal collection chamber 18 and a level control device 22 positioned in the metal collection chamber.

The electrolysis chamber 16 comprises three electrode assemblies, each including an anode 24, two cathodes 26, and four pairs of intermediate bipolar electrodes 28, 30, 32, 34. The electrodes are spaced from one another by means of insulating spacers (not shown), and are arranged vertically so as to provide vertical interelectrode spaces between adjacent electrodes.

The cathodes 26 rest on the refractory floor 14 of the cell. Between the pair of cathodes bounding each electrode assembly, bridges of refractory blocks 36 support rows of longitudinal refractory blocks 38, on each of which rests an anode or an intermediate electrode. The blocks 38 are of graded heights, the highest supporting the anode 24 and the lowest supporting the intermediate bipolar electrode 34 adjacent the cathode 26. In this way a configuration for fast electrolyte flow across the tops of the bipolar electrodes is achieved while nevertheless using bipolar electrodes of constant size.

The electrolysis chamber is lined, at the bottom by the longitudinal blocks 38, at the back and sides by the refractory lining 14 of the cell, and at the front by a curtain wall 40 of refractory blocks. This curtain wall 40 has downward extensions at 42 which rest on the bridges 36 and separate the electrode assemblies from the metal collection chamber 18. Between electrode assemblies, the curtain wall 40 extends down only far enough to separate magnesium metal in the collection chamber 18 from a head space 44 in the electrolysis chamber. Chlorine gas is retained in this head space by the roof 46 of the cell, and removed therefrom by a pipe 48.

Each anode 24 projects through the roof 46 of the cell and is connected to an anode bus bar 50. A potential problem is diffusion of gas from the atmosphere through the anodes (which are to some extent porous) into the electrolysis chamber. This problem is avoided by providing a secondary hood 52 round the top of each anode, and by ensuring that the region within this secondary hood is either filled with an inert gas such as argon or maintained at a pressure not greater than the pressure in the head space 44. Alternatively, a single removable hood could be provided round the tops of all the anodes. The cathodes 26 are connected, through the side wall of the cell, to a cathode bus bar 54. Connections are positioned well below the bottom of the other electrodes, so that corrosion of the refractory blocks 14 of the back wall is minimised in the electrolysis region.

The tops of the four intermediate bipolar electrodes 28, 30, 32, 34 are all at substantially the same height, with the top of 28 being slightly higher than 30, which is slightly higher than 32, which in turn is slightly higher than the top of 34. The top of each is rounded at 56 on its anode-facing side, to provide as far as possible a smooth non-turbulent path for electrolyte/metal mixture rising from the interelectrode regions to the duct 20. The top of the cathode 26 is lower than the tops of the intermediate bipolar electrodes, and the cathode is designed to remain submerged throughout operation.

A restricted passage 58 is provided in the duct 20 adjacent the top of the cathodes. Fixed to the back of each cathode is a row of refractory blocks 60. The restricted passage lies between facing pairs of these refractory blocks, or, at the ends of the electrolysis chamber, between a refractory block 60 and the wall 14 of the cell. Inverted channels 62 for metal collection are mounted on the back of each cathode 26 immediately below the refractory blocks 60. If desired, these channels 62 may be arranged to slope gently upwards from the back of the cell towards the metal collection chamber 18 to which they lead.

In the metal collection chamber, magnesium metal settles out as a surface layer 64 above an interface 66, the lower part of the chamber being filled with electrolyte. A metal tap hole 68 is provided.

The level control device 22 comprises a horizontal jacketed cylindrical vessel 70 closed at both ends and submerged in the electrolyte. The vessel is supported at both ends by pipes 72 which conduct air into and out of the jacket 74 as necessary to serve as a heat exchanger. The air inlet pipe is insulated at 76 to avoid local freezing of metal (as described in European Patent Specification 60048 A). A small diameter pipe (not shown) enables argon to be fed into, or out of the upper part 78 of the interior of the vessel. In the lower part of the vessel are holes 80 for the entry and exit of electrolyte. The surface of the electrolyte/magnesium mixture in the collection chamber can be raised by feeding argon into the vessel 70, thus expelling electrolyte, and can be lowered by bleeding argon out of the vessel. Automatic sensing means (not shown) can be provided to detect the surface level and maintain it substantially constant, e.g. during tapping of the magnesium or during introduction of magnesium chloride or other electrolyte components.

In operation, an electric current is passed between the anodes 24 and the cathodes 26 in the electrolysis chamber. The electrolyte is a conventional mixture of alkali and alkaline earth metal chlorides and possibly also fluorides, including magnesium fluoride, designed to be liquid at the chosen operating temperature just above the melting point of magnesium metal. Molten magnesium is formed on the cathodes 26 and on the anode-facing surfaces of the intermediate bipolar electrodes 28, 30, 32 and 34. Chlorine is formed on the anodes 24 and on the cathode-facing surfaces of the intermediate bipolar electrodes. A stream of rising chlorine bubbles fills the interelectrode space and the resulting upward flow of electrolyte entrains droplets of molten magnesium. The electrolyte/magnesium mixture reaching the liquid surface at the top of the electrolysis regions spills over the intervening intermediate electrodes and the cathode towards the duct 20. The electrolyte/metal mixture then passes down through the restricted passage 58, designed to produce a liquid flow of controlled turbulence to entrain magnesium droplets in the electrolyte and located at such a depth from the electrolyte surface as to cause any remaining chlorine gas to be released before the electrolyte/metal mixture reaches the passage. The dimensions of the restricted passage 58 are preferably such that there is a pressure drop across the passage of from 5 to 50 mm.

A key feature of the invention is the control of the surface level, in relation both to the tops of the intermediate bipolar electrodes and to the restricted passage. As noted above, the liquid surface should not be significantly higher than the tops of the intermediate bipolar electrodes, so as to minimise electric by-pass currents. The position of the restricted passage in relation to the liquid surface is a compromise between the need to achieve complete chlorine separation and the need to avoid a quiescent surface layer where magnesium droplets may coalesce and re-combine with chlorine.

Below the restricted passage 58, the flow of electrolyte slows down and turns through 90° towards and into the metal collection chamber 18. From there, the electrolyte turns through 180° and flows back below the electrode assemblies. Then the flow turns upward, between the insulating blocks 38, and into and up the electrolysis regions between the electrodes. Most of the magnesium metal entrained in the electrolyte passing through the restricted passage 58 is released in the duct 20 and collects in the inverted channel 62. Further magnesium metal is released by the electrolyte in the collection chamber 18. Magnesium from both these sources floats to the surface in the collection chamber 18 from where it is tapped.

Figure 3:
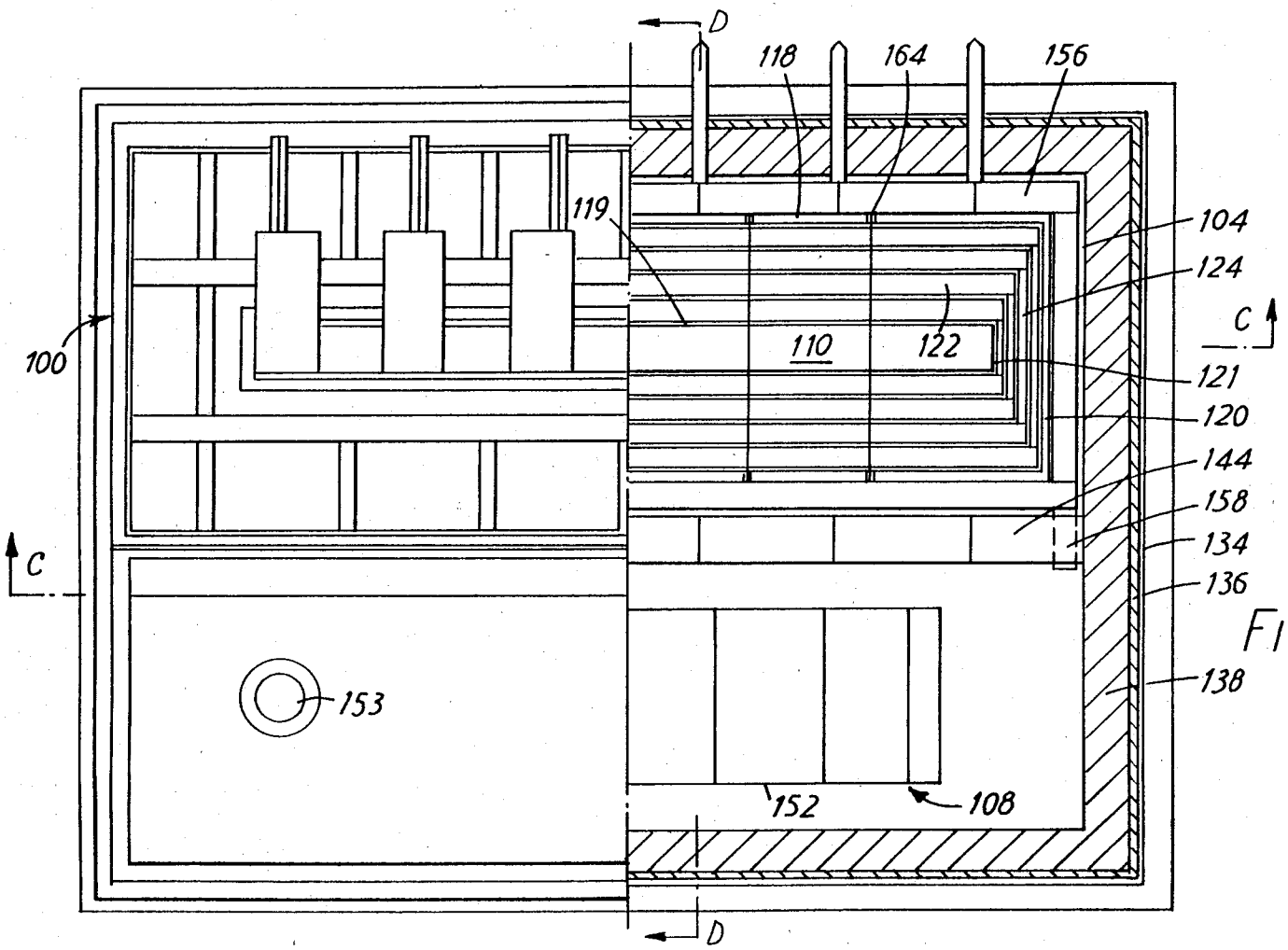
FIG. 3 is a plan view, partly in section, of an alternative design of electrolytic cell according to the invention.
Figure 4:
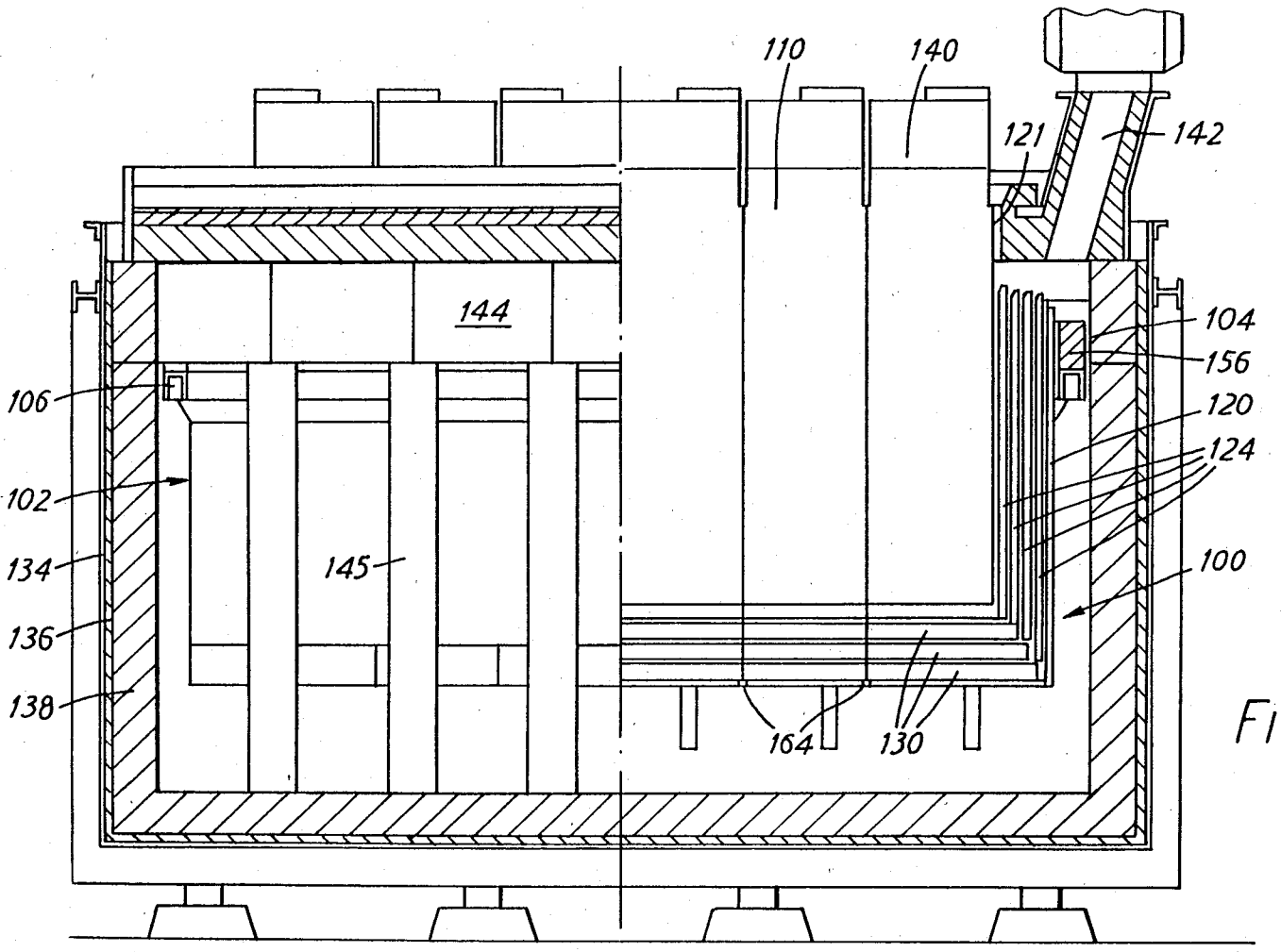
FIG. 4 is a sectional end elevation taken along the line C—C of FIG. 3.
Figure 5:
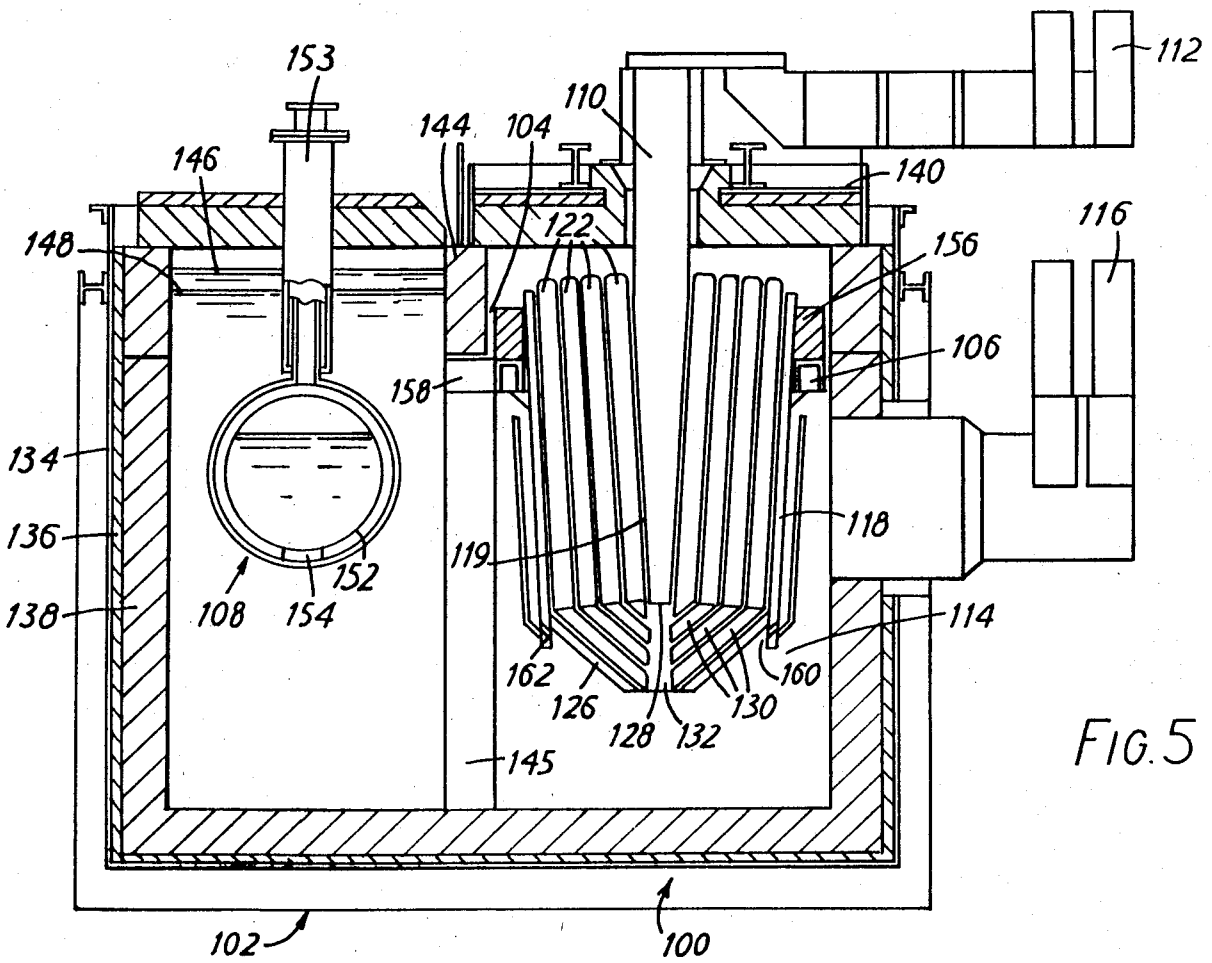
FIG. 5 is a sectional side elevation taken along the line D—D of FIG. 3.

FIGS. 3, 4 and 5 show an alternative design of electrolytic cell. Referring to these drawings, the cell comprises an electrolysis chamber 100, a metal collection chamber 102, a duct including a restricted passage 104 for electrolyte/metal mixture and an inverted channel 106 for metal collection, and a level control device 108 positioned in the collection chamber.

The electrolysis chamber contains a single anode 110 in the form of elongated wedge shaped blocks of graphite positioned next to each other along a continuous axial line, and connected to an electrical supply by means of an anode bus bar 112. The anode is completely surrounded by steel cathodes 114 connected to an electrical supply by a cathode bus bar 116. The cathodes comprise side faces, 118 at a small angle to the vertical and facing the major faces 119 of the anode; and vertical end faces 120 facing the vertical ends 121 of the anode. Sandwiched between the cathode faces 118 and the anode faces 119 are four intermediate bipolar electrodes 122. Sandwiched between the cathode faces 120 and the anode ends 121 are four intermediate bipolar electrodes 124. Steel plates 126 are welded to the faces 118 of the cathodes towards their bottom edge. These plates, which form extensions of the cathodes, are inclined at an angle of about 45° to the vertical. Between these plates 126 and the bottom 128 of the anode are positioned three intermediate bipolar electrodes 130, also inclinded at about 45° to the vertical. A narrow gap 132 is left between the inclined sets of intermediate electrodes 130 for entry of electrolyte into the system. The inclined electrolysis regions between the plates 126 and the intermediate electrodes 130 are in communication with the substantially vertical electrolysis regions between the cathode faces 118, the intermediate electrodes 122 and the anode 110, so that there is a continuous flow of electrolyte up these regions. All electrodes are spaced from one another by means of insulating spacers (not shown).

The cell comprises a steel outer shell 134, a layer 136 of themal insulation, and a massive refractory lining 138 of material which is resistant to both molten magnesium and the molten electrolyte to be used. The electrolysis region is closed by means of an insulated lid 140 provided with a vent 142 for removal of chlorine gas.

The magnesium collection chamber 102 is separated from the electrolysis chamber 100 by means of a curtain wall 144 which extends down from the roof of the cell to below the electrolyte surface, supported by pillars 145. In the collection chamber, magnesium metal rises to the surface and forms a layer 146 above an interface 148, from which it can be removed by means not shown. A level control device 108 is similar to that described and illustrated in FIGS. 1 and 2 and consists of an elongated horizontal vessel 152 supported at both ends by pipes 153, with holes 154 on its bottom side for entry or exit of electrolyte. Means (not shown) are provided for controlling the flow of argon gas into or out of the upper part of this vessel, so as to draw in, or expel, electrolyte from the vessel and change the surface level in the cell accordingly.

Adjacent the back faces of the cathode, 118, 120 are blocks 156 of insulating material. On three sides of the electrolysis chamber, the restricted passage 104 for electrolyte/metal mixture is formed between these blocks and the insulating blocks 138 lining the cell. On the fourth side, between the electrolysis chamber and the magnesium collection chamber, the restricted passage 104 is formed between the insulating blocks 156 and the curtain wall 144. Mounted below the blocks is the inverted channel 106 for the collection of magnesium metal. This channel extends continuously all round the electrode assembly, and extensions 158 are provided to convey metal below the curtain wall 144 into the magnesium collection chamber. The channel may, but need not, slope upwards towards the magnesium collection chamber.

The sloping metal plates 126 form, with the bottom edges of the electrode faces 118, secondary channels 160 for magnesium collection. Apertures 162 in the bottom edges of the electrode faces 118 permit passage of magnesium metal from these secondary channels and up to the primary collection channels 106.

The steel cathodes are divided by expansion joints 164 into elements small enough for the different rates of thermal expansion of steel and graphite not to become a serious problem. The expansion joints are of such a size as to avoid the accumulation of movement as the number of cathodes increases.

Operation of the cell is similar to that of the cell described in FIGS. 1 and 2. A mixture of electrolyte, magnesium and chlorine streams up the electrolysis regions between the electrodes, and spills over the intermediate electrodes and the cathode onto the refractory blocks 156 and down the restricted passages 104. Thereafter, the rate of electrolyte flow slows down, the magnesium droplets are collected in the channels 106 and 160 and passed to the magnesium collection chamber. Freed of magnesium metal, the electrolyte enters the passage 132, and so passes up again into the electrolysis regions between the electrodes. Thus, electrolyte substantially circulates round the cathodes, and circulation of electrolyte to and from the magnesium collecting chamber is only partial.

By virtue of the cathodes 120 and 126, and intermediate electrodes, 124 and 130, surrounding the ends 121 and the bottom 128 of the anode, electrical by-pass currents are reduced to a very low level. Thus, the cell achieves the advantages of using intermediate bipolar electrodes, that they increase the effective cathode area on which metal formation can take place, without either increasing the size of the cell or increasing the heat and power loss involved in providing large numbers of external electrical connections, while avoiding a major potential disadvantage of such intermediate bipolar electrodes.

The cell described illustrated in FIGS. 3 to 5 represents our currently preferred embodiment, but could be modified in various ways within the scope of the invention:

(a) The cathode faces 126 and the intermediate bipolar electrodes 130 could be omitted and replaced by insulating blocks designed to minimize electrical by-pass currents below the intermediate electrodes 122 and 124.

(b) The cathode faces 120 and the intermediate bipolar electrodes 124 could be omitted and replaced by insulating blocks designed to minimize electrical by-pass currents round the ends of the intermediate electrodes 122 and 130.

(c) Both steps (a) and (b) could be taken at the same time, leaving only the intermediate electrodes 122.

(d) In place of a single anode, several rectangular anodes could be used, each surrounded on some or all sides by cathodes and intermediate bipolar electrodes.

(e) The rectangular anode(s) could be arranged to extend perpendicular to, rather than parallel to, the adjoining magnesium collection chamber.

(f) The anode(s) could have a horizontal cross-section which is square or circular rather than rectangular.

(g) The anode(s) could taper in a downward direction, i.e. the anode(s) could be conical or pyramidal, rather than cylindrical or rectangular.

I claim:

1. An electrolyte cell for the production of a metal by electrolysis of a molten electrolyte which is more dense than the metal, comprising, an electrolysis chamber 16 including at least one electrode assembly of a anode 24 having a major face and also at least one other face selected from an end face and a bottom face, one or more intermediate bipolar electrodes 28, 30, 32, 34 arranged facing not only the major face of the anode but also at least one other face of the anode, and a cathode 26 having a front face facing an intermediate bipolar electrode and a back face, the electrodes defining electrolysis regions between them, and a gas collection space 44 above the assembly, a metal collection chamber 18 in communication with the top and bottom of the electrolysis regions, but screened from the gas collection space, a duct 20 defined by the back face of the cathode and leading to the metal collection chamber and to the gas collection space to cause gas to separate and electrolyte/metal mixture to flow to the metal collection chamber, the one or more intermediate bipolar electrodes having top edges arranged to permit electrolyte/metal mixture rising from the electrolysis regions to spill out over the bipolar electrodes and cathode and into the duct, and means 22, for maintaining the surface of the electrolyte/metal mixture at a substantially constant level.

2. A cell as claimed in claim 1, wherein the top edge of each intermediate bipolar electrode is horizontal and rounded on its anode-facing side.

3. A cell as claimed in claim 1, wherein the top edges of all the intermediate bipolar electrodes are substantially at the same height.

4. A cell as claimed in claim 1, wherein the means for maintaining the surface of the electrolyte/metal mixture at a substantially constant level comprises a level control device in the form of a vessel partly or wholly submerged in the electrolyte of the metal collection chamber, to or from which electrolyte can be transferred to alter the surface level.

* * * * *